US010047962B2

(12) United States Patent
Ugajin et al.

(10) Patent No.: US 10,047,962 B2
(45) Date of Patent: Aug. 14, 2018

(54) INDOOR UNIT FOR AIR-CONDITIONING APPARATUS

(71) Applicant: Mitsubishi Electric Corporation, Tokyo (JP)

(72) Inventors: Yuki Ugajin, Tokyo (JP); Hideaki Maeyama, Tokyo (JP); Akira Ishibashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/510,850

(22) PCT Filed: Nov. 4, 2014

(86) PCT No.: PCT/JP2014/079201
§ 371 (c)(1),
(2) Date: Mar. 13, 2017

(87) PCT Pub. No.: WO2016/071953
PCT Pub. Date: May 12, 2016

(65) Prior Publication Data
US 2017/0292720 A1 Oct. 12, 2017

(51) Int. Cl.
*F24D 19/02* (2006.01)
*F24F 1/00* (2011.01)

(52) U.S. Cl.
CPC ..... *F24F 1/0059* (2013.01); *F24F 1/0025* (2013.01); *F24F 2001/0048* (2013.01)

(58) Field of Classification Search
CPC ..... F24F 3/065; F24F 5/0017; F24F 1/0059; F24F 1/0025; F24F 2001/0048; F25B 1/10
(Continued)

(56) References Cited

U.S. PATENT DOCUMENTS 6,062,035 A * 5/2000 Ueno ..... F24F 5/0017 62/324.1
2011/0192176 A1* 8/2011 Kim ..... F24F 3/065 62/115
2015/0052927 A1* 2/2015 Yang ..... F25B 1/10 62/238.7

FOREIGN PATENT DOCUMENTS

JP 04-222363 A 8/1992
JP 10-205803 A 8/1998
(Continued)

OTHER PUBLICATIONS

International Search Report of the International Searching Authority dated Feb. 10, 2015 for the corresponding international application No. PCT/JP2014/079201 (and English translation).

*Primary Examiner* — Davis Hwu
(74) *Attorney, Agent, or Firm* — Posz Law Group, PLC

(57) ABSTRACT

An indoor unit for an air-conditioning apparatus includes a main heat exchanger unit and a sub heat exchanger unit, the main heat exchanger unit includes a first main heat exchanger disposed at a front side of a case and a first heat-transfer pipe extending in a vertical direction, and a second main heat exchanger disposed at a back side of the case and a second heat-transfer pipe extending in the vertical direction. The sub heat exchanger unit includes a leeward-side first sub heat exchanger disposed at a leeward side of the first main heat exchanger and a heat-transfer pipe extending in a width direction, and a leeward-side second sub heat exchanger including a heat-transfer pipe extending in the width direction. The leeward-side second sub heat exchanger has a lower end surface located above an air passage wall and is disposed at a leeward side of the second main heat exchanger.

14 Claims, 11 Drawing Sheets

(58) Field of Classification Search
USPC ..... 165/55
See application file for complete search history.

(56) References Cited

FOREIGN PATENT DOCUMENTS

| | | | |
|---|---|---|---|
| JP | 2002-147781 | A | 5/2002 |
| JP | 2008-256305 | A | 10/2008 |
| JP | 2010-025456 | A | 2/2010 |
| JP | 2010-133656 | A | 6/2010 |
| JP | 2012-107841 | A | 6/2012 |
| JP | 2012-225531 | A | 11/2012 |

* cited by examiner

INDOOR UNIT FOR AIR-CONDITIONING APPARATUS

CROSS REFERENCE TO RELATED APPLICATION

This application is a U.S. national stage application of PCT/JP2014/079201 filed on Nov. 4, 2014, the contents of which are incorporated herein by reference.

TECHNICAL FIELD

The present invention relates to an indoor unit for an air-conditioning apparatus including a heat exchanger in which a heat-transfer pipe extends in the vertical direction.

BACKGROUND ART

An indoor unit equipped with a parallel flow type heat exchanger as a heat exchanger of an indoor unit has been known (see, for example, Patent Literature 1 and 2). Patent Literature 1 discloses an indoor unit including a heat exchanger in which a plurality of heat-transfer pipes and fins extending in the vertical direction are stacked alternately, and a liquid-side header and a gas-side header extending in the horizontal direction are connected to both ends of the heat-transfer pipes. During cooling operation, refrigerant is distributed to the plurality of heat-transfer pipes at the liquid-side header and flows from the plurality of heat-transfer pipes into the gas-side header. On the other hand, during heating operation, the refrigerant is distributed to the plurality of heat-transfer pipes at the gas-side header and flows from the plurality of heat-transfer pipes into the liquid-side header.

Furthermore, Patent Literature 2 discloses an indoor unit in which a fin-and-tube-type heat exchanger is disposed at the leeward side of a parallel flow type heat exchanger. Defrost water or dew condensation water generated in the parallel flow type heat exchanger moves to the fin-and-tube-type heat exchanger due to the gravity and is drained.

CITATION LIST

Patent Literature

Patent Literature 1: Japanese Unexamined Patent Application Publication No. 2008-256305 (FIG. 8, FIG. 9)

Patent Literature 2: Japanese Unexamined Patent Application Publication No. 2010-25456

SUMMARY OF INVENTION

Technical Problem

In Patent Literature 2, however, the fin-and-tube-type heat exchanger is disposed over the entirety of the parallel flow type heat exchanger. Thus, the thickness of the heat exchanger increases, resulting in an increase in the thickness (depth) of the indoor unit.

The present invention has been made to solve the above-described problem, and an object of the present invention is to provide an indoor unit for an air-conditioning apparatus in which occurrence of dew water is inhibited while the size of the indoor unit is reduced.

Solution to Problem

An indoor unit for an air-conditioning apparatus according to an embodiment of the present invention includes a case, an air-sending fan accommodated in the case, a main heat exchanger unit provided to cover the air-sending fan and configured to exchange heat between refrigerant and air, and a sub heat exchanger unit provided to a leeward side of the main heat exchanger unit. The main heat exchanger unit includes a first main heat exchanger disposed at a front side of the case and including a first heat-transfer pipe extending in a vertical direction, and a second main heat exchanger disposed at a back side of the case and including a second heat-transfer pipe extending in the vertical direction. The case includes an air passage wall arranged between the air-sending fan and the second main heat exchanger and forming an air passage through which air sent from the air-sending fan flows. The sub heat exchanger unit includes a leeward-side first sub heat exchanger disposed at a leeward side of the first main heat exchanger and including a heat-transfer pipe extending in a width direction of the case, and a leeward-side second sub heat exchanger including a heat-transfer pipe extending in the width direction of the case. The leeward-side second sub heat exchanger has a lower end surface located above the air passage wall. The leeward-side second sub heat exchanger is disposed at a leeward side of the second main heat exchanger to cover a part of an upper portion of the second main heat exchanger.

Advantageous Effects of Invention

In the indoor unit for an air-conditioning apparatus according to the embodiment of the present invention, as the leeward-side second sub heat exchanger has a shape covering the part of the upper portion of the second main heat exchanger and has the lower end surface located above the air passage wall, no extra space for disposing the sub heat exchanger unit is necessary between the air-sending fan and the lower end of the main heat exchanger unit, and dew water can be prevented from entering the air passage while size reduction of the indoor unit 1 is achieved.

DESCRIPTION OF EMBODIMENTS

Embodiment 1

Figure 1:
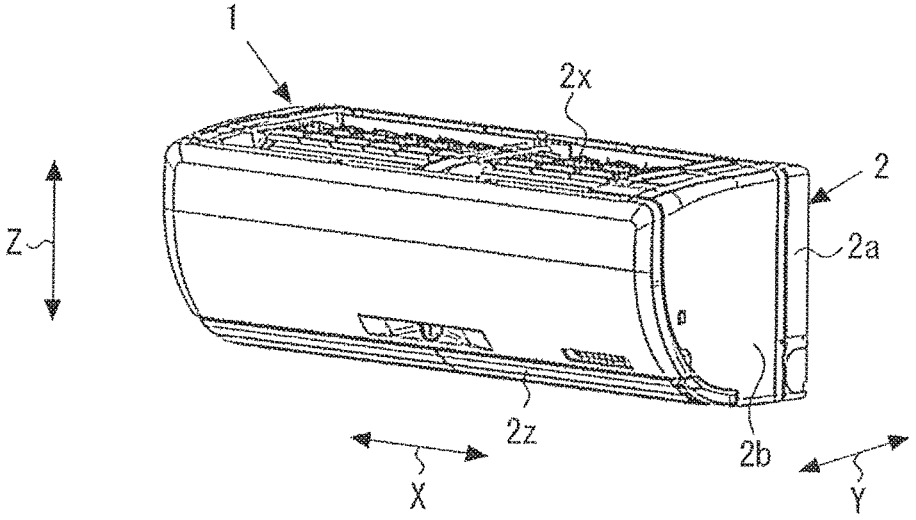
FIG. 1 is a perspective view showing an indoor unit for an air-conditioning apparatus according to Embodiment 1 of the present invention.
Figure 2:
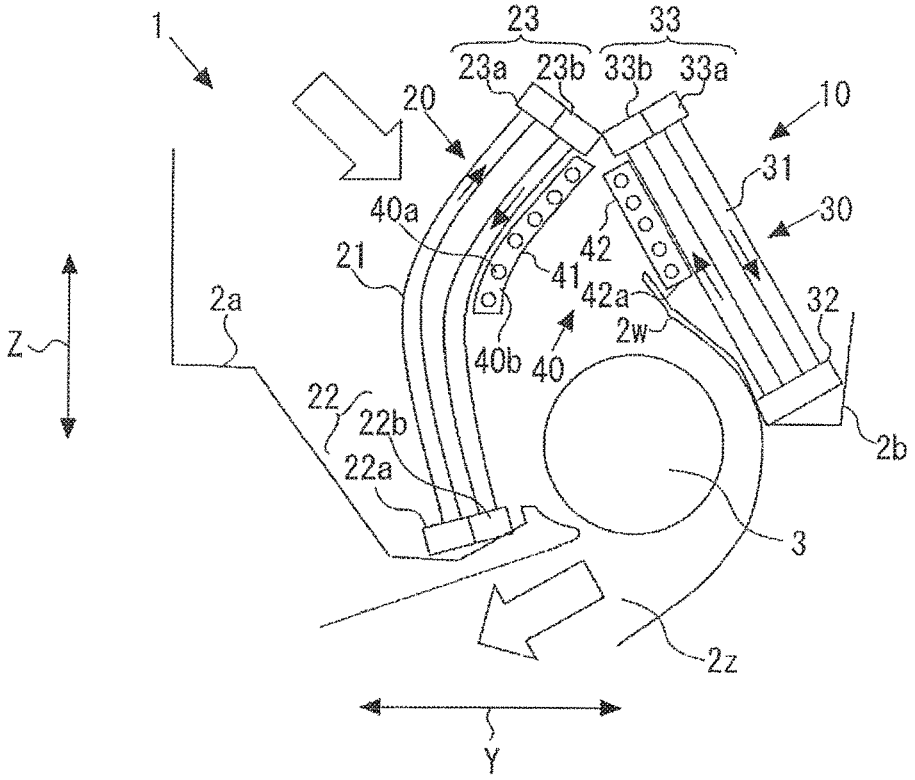
FIG. 2 is a cross-sectional view showing the indoor unit for an air-conditioning apparatus according to Embodiment 1 of the present invention.

Hereinafter, preferred embodiments of the indoor unit for an air-conditioning apparatus of the present invention are described with reference to the drawings. FIG. 1 is a perspective view showing the indoor unit for an air-conditioning apparatus according to Embodiment 1 of the present invention, and FIG. 2 is a cross-sectional view showing the indoor unit for an air-conditioning apparatus according to Embodiment 1 of the present invention. The indoor unit 1 in FIGS. 1 and 2 is a wall-mounted type indoor unit that is provided, for example, on a wall in a room, and includes a case 2, an air-sending fan 3 accommodated in the case 2, a main heat exchanger unit 10 that is accommodated in the case 2 and to which air is sent by the air-sending fan 3, and a sub heat exchanger unit 40 provided at the air flow direction side of the main heat exchanger unit 10.

The case 2 includes a back case 2*a* and a front case 2*b* that are formed from a material such as resin, the back case 2*a* is fixed to a wall or other structure, and the front case 2*b* is attached to the back case 2*a*. In addition, the air-sending fan 3 and the main heat exchanger unit 10 are mounted on the back case 2*a*. The back case 2*a* includes, at a position opposed to the air-sending fan 3, an air passage wall 2*w* that forms an air passage through which air sent from the air-sending fan 3 flows, and the air passage wall 2*w* has, for example, a tilted shape such as a circular arc shape.

The front case 2*b* has an air inlet 2*x* formed in a top surface of the front case 2*b*, and has an air outlet 2*z* through which conditioned air having exchanged heat in the main heat exchanger unit 10 is blown out. A vertical air direction adjusting plate (flap) is pivotally disposed in the air outlet 2*z* and adjusts the direction of the conditioned air blown out through the air outlet 2*z*.

The air-sending fan 3 is composed of, for example, a line flow fan such as a cross flow fan and a through flow fan, and is provided in an air passage from the air inlet 2*x* to the air outlet 2*z* and at the downstream side of the main heat exchanger unit 10 and the upstream side of the air outlet. The air-sending fan 3 sucks indoor air through the air inlet 2*x* and blows out conditioned air through the air outlet 2*z*. One end side of the air-sending fan 3 is rotatably supported by the back case 2*a* via a bearing or other component and is connected to a motor.

During cooling operation, the main heat exchanger unit 10 serves as an evaporator to cool air. During heating operation, the main heat exchanger unit 10 serves as a condenser to heat air. The main heat exchanger unit 10 is disposed at the upstream side of the air-sending fan 3 and is shaped to cover the front surface and the upper surface of the air-sending fan 3. The main heat exchanger unit 10 includes a first main heat exchanger 20 located at a side of the front case 2*b* and at the front side of the air-sending fan 3, and a second main heat exchanger 30 located at a side of the back case 2*a* and tilted to the rear side of the air-sending fan 3.

Figure 3:
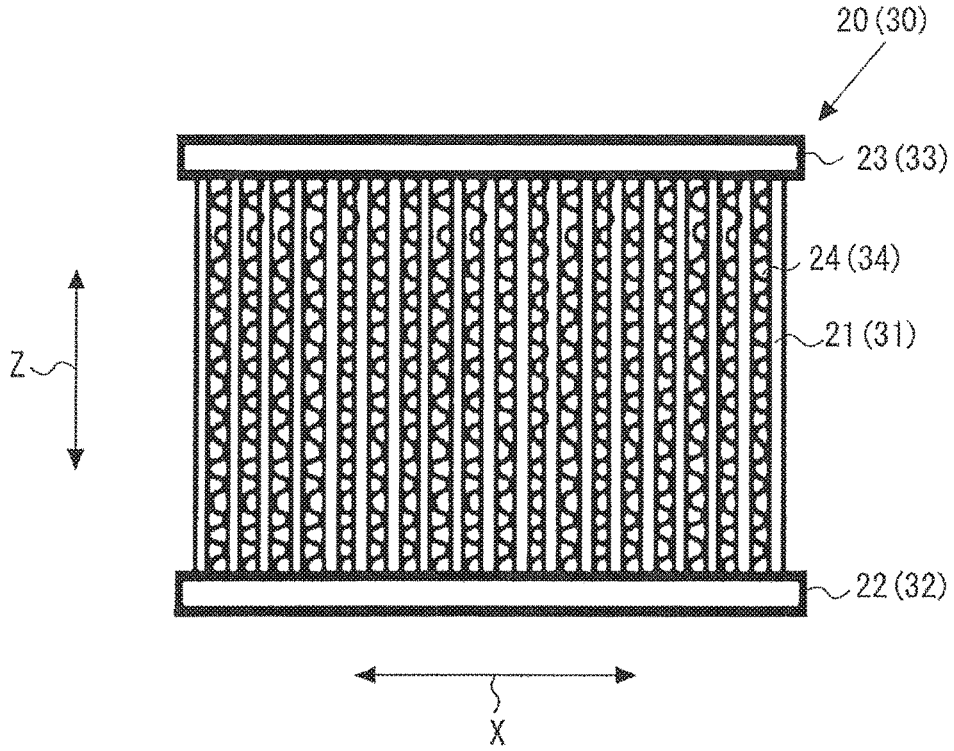
FIG. 3 is a schematic diagram showing an example of a first main heat exchanger of the indoor unit for an air-conditioning apparatus in FIG. 2.

FIG. 3 is a schematic diagram showing an example of the first main heat exchanger in the indoor unit for an air-conditioning apparatus in FIG. 2. As shown in FIGS. 2 and 3, the first main heat exchanger 20 includes a plurality of first heat-transfer pipes 21 arranged in each of a width direction of the case 2 (an arrow X direction) and an air flow direction, a first lower header 22 connected to the lower ends of the plurality of first heat-transfer pipes 21, and a first upper header 23 connected to the upper ends of the plurality of first heat-transfer pipes 21. The first heat-transfer pipes 21 have a structure in which, for example, a plurality of flattened pipes each having a plurality of refrigerant passages in the air flow direction (the thickness direction of the main heat exchanger unit) are arranged in the width direction of the case 2 (the arrow X direction). Alternatively, the first heat-transfer pipes 21 may be composed of a plurality of pipes each having one refrigerant passage and arranged in the air flow direction.

The plurality of first heat-transfer pipes 21 are arranged to extend in the vertical direction (an arrow Z direction). In particular, the plurality of first heat-transfer pipes 21 are each formed in a curved shape projecting toward the front case 2*b* and have a shape having an increased mount area as compared to the case of a linear shape. In addition, the first main heat exchanger 20 includes first heat transfer fins 24 arranged between the plurality of first heat-transfer pipes 21 arranged in the width direction of the case 2 (the arrow X direction), and the first heat transfer fins 24 exchange heat between air and refrigerant flowing through the first heat-transfer pipes 21.

The second main heat exchanger 30 has a structure similar to that of the first main heat exchanger 20 shown in FIG. 3, and includes a plurality of second heat-transfer pipes 31 arranged in each of the width direction of the case 2 (the arrow X direction) and the air flow direction, a second lower header 32 connected to the lower ends of the plurality of second heat-transfer pipes 31, and a second upper header 33 connected to the upper ends of the plurality of second heat-transfer pipes 31. The second heat-transfer pipes 31 have a structure in which, for example, a plurality of flattened pipes each having a plurality of refrigerant passages in the air flow direction (the thickness direction of the main heat exchanger unit) are arranged in the width direction of the case 2 (the arrow X direction). Alternatively, the second heat-transfer pipes 31 may be composed of a plurality of pipes each having one refrigerant passage and arranged in the air flow direction. The second heat-transfer pipes 31 are formed in a linear shape to extend in the vertical direction (the arrow Z direction). In addition, the second main heat exchanger 30 includes second heat transfer fins 34 arranged between the plurality of second heat-transfer pipes 31 arranged in the width direction of the case 2 (the arrow X direction), and the second heat transfer fins 34 exchange heat between air and the refrigerant flowing through the second heat-transfer pipes 31.

FIG. 2 shows, as an example, the case where each of the first upper header 23, the first lower header 22, the second upper header 33, and the second lower header 32 has a substantially rectangular cross-sectional shape. However, the shape of each of the first upper header 23, the first lower header 22, the second upper header 33, and the second lower header 32 is not limited to this shape, and each of the first upper header 23, the first lower header 22, the second upper header 33, and the second lower header 32 may be formed, for example, in a circular cross-sectional shape or other shape. In addition, the first main heat exchanger 20 and the second main heat exchanger 30 are not limited to the case where each of the first main heat exchanger 20 and the second main heat exchanger 30 has a fin structure as shown in FIG. 3, as long as the first main heat exchanger 20 and the second main heat exchanger 30 are formed so that the first heat-transfer pipes 21 and the second heat-transfer pipes 31 extend in the vertical direction (the arrow Z direction). In the first main heat exchanger 20 and the second main heat exchanger 30, for example, the heat-transfer pipes (flattened pipes) may serve as fins and exchange heat between air and the refrigerant flowing through the refrigerant passages.

As described above, a plurality of headers, that is, the first upper header 23, the first lower header 22, the second upper header 33, and the second lower header 32 are provided in the main heat exchanger unit 10. Here, each of the first upper header 23 and the first lower header 22 of the first main heat exchanger 20 is composed of a plurality of division headers that divide the plurality of refrigerant passages arranged in the air flow direction. Meanwhile, in the second main heat exchanger 30, the second upper header 33 is a division header, and the second lower header 32 is a return header that turns back the refrigerant passages in the air flow direction. As described above, in the main heat exchanger unit 10, the division header and the return header are provided in at least either one of the first main heat exchanger 20 or the second main heat exchanger 30.

Specifically, the first lower header 22 of the first main heat exchanger 20 includes first lower division headers 22*a* and 22*b* that divide the plurality of first heat-transfer pipes 21 in the thickness direction into different refrigerant passages, and the first upper header 23 of the first main heat exchanger 20 includes first upper division headers 23*a* and 23*b* that divide the plurality of refrigerant passages in the air flow direction. The first lower division header 22*a* and the first upper division header 23*a* are connected to one or more refrigerant passages at the front side among the plurality of refrigerant passages arranged in the air flow direction. The first lower division header 22*b* and the first upper division header 23*b* are connected to one or more refrigerant passages at the back side. Consequently, in the first main heat exchanger 20, two large refrigerant passages are formed in the air flow direction.

Figure 4:
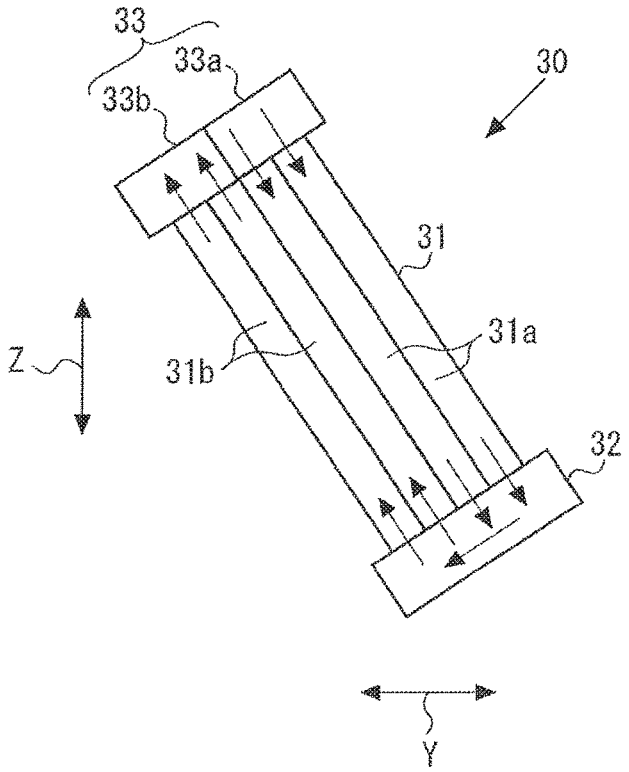
FIG. 4 is a schematic diagram showing an example of a second main heat exchanger of the indoor unit for an air-conditioning apparatus in FIG. 2.

FIG. 4 is a schematic diagram showing an example of the second main heat exchanger in the indoor unit for an air-conditioning apparatus in FIG. 2. In the second main heat exchanger 30 in FIGS. 2 and 4, the second upper header 33 includes second upper division headers 33*a* and 33*b* that divide the plurality of refrigerant passages in the air flow direction. Meanwhile, the second lower header 32 is a return header and forms a refrigerant passage that connects and turns back a plurality of refrigerant passages 31*a* and 31*b* arranged in the air flow direction. The second upper division headers 33*a* and 33*b* are connected to the first upper division headers 23*a* and 23*b* of the first main heat exchanger 20, respectively, so that the refrigerant flows continuously between the first main heat exchanger 20 and the second main heat exchanger 30. At this time, refrigerant passages that cause counterflows are formed in the first main heat exchanger 20 and the second main heat exchanger 30.

The sub heat exchanger unit 40 in FIG. 2 is provided at the leeward side of the main heat exchanger unit 10 and is connected to allow the refrigerant flowing out from the main heat exchanger unit 10 to flow through the sub heat exchanger unit 40, for example. The sub heat exchanger unit 40 includes a leeward-side first sub heat exchanger 41 disposed at the leeward side of the first main heat exchanger, and a leeward-side second sub heat exchanger 42 disposed at the leeward side of the second main heat exchanger 30. Each of the leeward-side first sub heat exchanger 41 and the leeward-side second sub heat exchanger 42 includes a plurality of heat-transfer pipes 40*a* extending in the width direction (the arrow X direction) and a heat transfer fins 40*b* connected to the plurality of heat-transfer pipes 40*a*. The heat-transfer pipes 40*a* are composed of, for example, circular heat-transfer pipes, and are connected to each other to meander. The heat transfer fins 40*b* are each formed, for example, in a plate shape and is inserted and connected to the heat-transfer pipes 40*a*.

In this case, the heat transfer fins 40*b* are disposed to have the fin pitch of 1.0 to 1.5 mm. Dew dropping from the main heat exchanger unit 10 has a size of 3 to 4 mm. Thus, when the fin pitch is not greater than 1.5 mm, dew can be prevented from passing through the sub heat exchanger unit 40 and dropping to the air-sending fan 3 located below the sub heat exchanger unit 40. In addition, when the fin pitch decreases, the heat-transfer performance is enhanced, and the shaft input of the air-sending fan 3 increases. On the other hand, when the fin pitch increases, the heat-transfer performance is decreased, and the shaft input of the air-sending fan 3 reduces. Regarding the relationship between the heat-transfer performance and the shaft input, a proper fin pitch causes a COP (coefficient of performance) in a rated test to be at its maximum. When the fin pitch is less than 1.0 mm, air pressure loss increases, and the fan shaft input increases. Thus, the fin pitch is preferably not less than 1.0 mm.

The leeward-side second sub heat exchanger 42 has a shape covering a part of an upper portion of the second main heat exchanger 30 and has a lower end surface 42*a* located above the air passage wall 2*w*. The leeward-side first sub heat exchanger 41 covers, for example, 80% or less of the total area of the first main heat exchanger 20, and particularly preferably covers 50% or greater of the total area. Here, the air passage wall 2*w* has, for example, a substantially circular arc shape covering the air-sending fan 3 from the lower side to the upper side at the back side, and has a shape in which the upper end side bends to the air-sending fan 3 side. The air passage wall 2*w* is opposed to the lower end of the second main heat exchanger 30, and a gap is left at the upper end side and between the air passage wall 2*w* and the second main heat exchanger 30. The leeward-side second sub heat exchanger 42 is disposed in the gap. Consequently, the lower end surface 42*a* of the leeward-side second sub heat exchanger 42 is located above the air passage wall 2*w*.

As the leeward-side second sub heat exchanger 42 is provided to cover the part of the upper portion of the second main heat exchanger 30 as described above, no extra space for the leeward-side second sub heat exchanger 42 is necessary, and the size of the indoor unit can be reduced in the thickness direction (an arrow Y direction). Thus, the indoor unit can be downsized. In this case, as the lower end surface 42*a* of the leeward-side second sub heat exchanger 42 is located above the air passage wall 2*w*, dew dropping from the leeward-side second sub heat exchanger 42 can be prevented from dropping to the side of the air-sending fan 3.

In addition, the leeward-side first sub heat exchanger 41 has a shape covering a part of an upper portion of the first main heat exchanger 20. The leeward-side first sub heat exchanger 41 covers, for example, 80% or less of the total area of the first main heat exchanger 20, and particularly preferably covers 50% or greater of the total area. Thus, no extra gap for disposing the leeward-side first sub heat exchanger 41 is necessary between the first main heat exchanger 20 and the air-sending fan 3, and thus the indoor unit 1 can be further downsized. The sub heat exchanger unit 40 covers 80% or less of the total area of the main heat exchanger unit 10 as a whole.

Next, flow of the refrigerant is described with reference to FIGS. 2 to 4. For example, the refrigerant flowing in through the first lower division header 22*a* of the first main heat exchanger 20 flows through the refrigerant passages at the front side in the first heat-transfer pipes 21 into the first upper division header 23*a*. Subsequently, the refrigerant in the first upper division header 23*a* flows to the second upper header 33 of the second main heat exchanger 30, and flows from the second upper header 33 at the back side through the refrigerant passages at the back side in the plurality of second heat-transfer pipes 31 into the second lower header 32. The refrigerant is turned back in the second lower header 32, flows through the refrigerant passages at the front side in the second heat-transfer pipes 31 in the second main heat exchanger 30, and flows into the second upper division header 33*b*. The refrigerant in the second upper division header 33*b* flows into the first upper division header 23*b* at the back side (the air-sending fan 3 side), flows through the refrigerant passages at the back side in the first heat-transfer pipes 21 into the first lower division header 22*b*, and flows out from the main heat exchanger unit 10 to the sub heat exchanger unit 40. In the sub heat exchanger unit 40, the refrigerant flows in parallel into the leeward-side first sub heat exchanger 41 and the leeward-side second sub heat exchanger 42, and then flows out to an outdoor unit.

Figure 5:
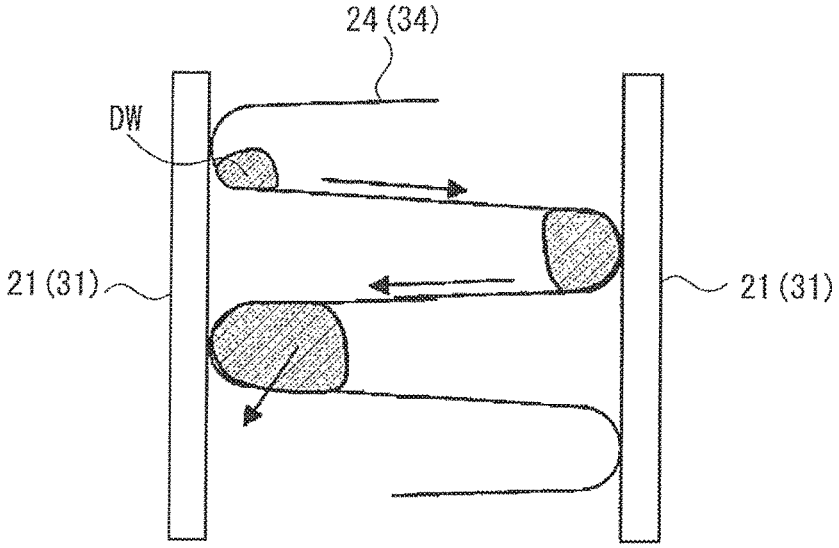
FIG. 5 is a schematic diagram showing a state where dew water occurs in a main heat exchanger unit 10 in FIG. 3.

FIG. 5 is a schematic diagram showing a state where dew water occurs in the main heat exchanger unit 10 in FIG. 3. When dew water DW such as dew condensation water occurs in the first heat transfer fins 24 and the second heat transfer fins 34 in the main heat exchanger unit 10, the dew water DW becomes larger while dropping in the first heat transfer fins 24 and the second heat transfer fins 34, and drops from the main heat exchanger unit 10 in FIG. 2 onto the sub heat exchanger unit 40. Then, in the sub heat exchanger unit 40, the dew water at the side of the leeward-side first sub heat exchanger 41 drops from the lower end of the leeward-side first sub heat exchanger 41 onto a drain pan of the front case 2*b*. Meanwhile, the dew water at the side of the leeward-side second sub heat exchanger 42 drops from the lower end surface 42*a* onto the air passage wall 2*w*.

According to Embodiment 1 described above, the first main heat exchanger 20 and the second main heat exchanger 30 of the main heat exchanger unit 10 are parallel flow type heat exchangers, and thus the refrigerant can be evenly distributed to the plurality of heat-transfer pipes without influence of the gravity. Consequently, a decrease in the heat exchange efficiency caused by to the refrigerant unevenly flowing through a partial region of the heat exchanger can be reduced. In this case, as the sub heat exchanger unit 40 is provided at the leeward side of the main heat exchanger unit 10, defrost water or dew condensation water occurring in the main heat exchanger unit 10 moves to the sub heat exchanger unit 40 due to the gravity, and is drained.

In this case, as the leeward-side second sub heat exchanger 42 has a shape covering the part of the upper portion of the second main heat exchanger 30 and has the lower end surface 42*a* located above the air passage wall 2*w*, no extra space for disposing the sub heat exchanger unit 40 is necessary between the air-sending fan 3 and the main heat exchanger unit 10, and thus the indoor unit 1 can be downsized.

Figure 6:
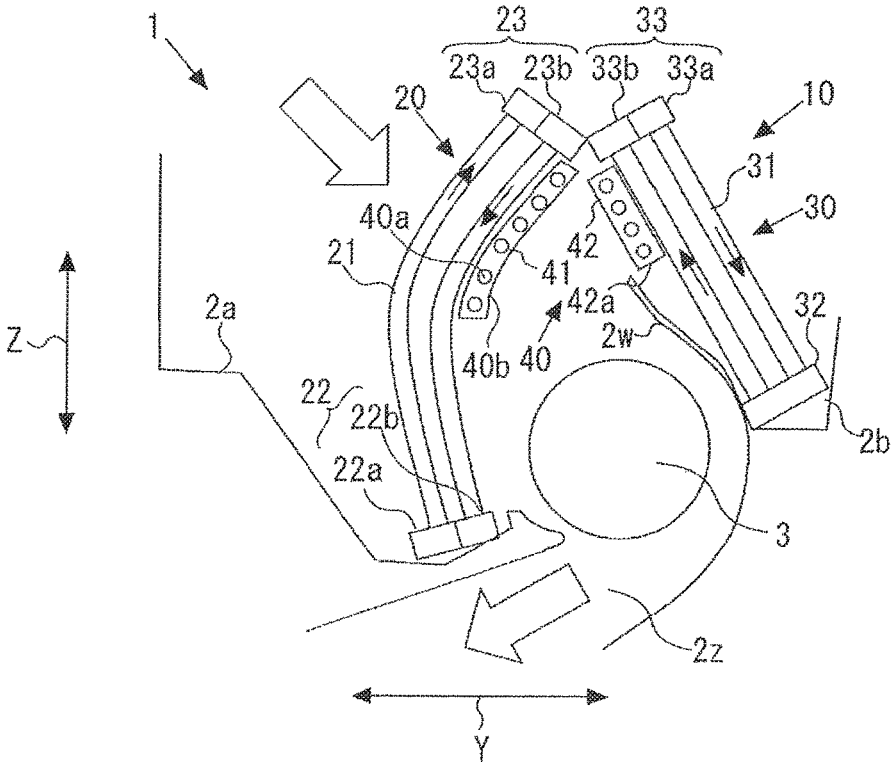
FIG. 6 is a cross-sectional view showing a modification of the indoor unit for an air-conditioning apparatus according to Embodiment 1 of the present invention.
Figure 7:
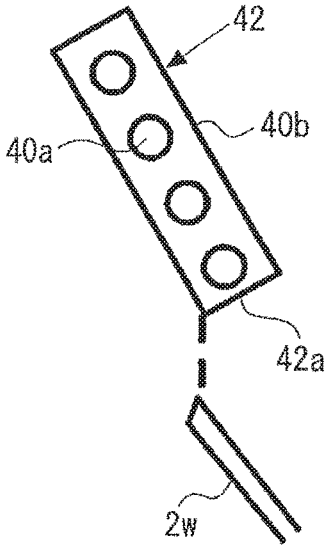
FIG. 7 is a schematic diagram showing a lower end surface of a second sub heat exchanger in FIG. 6.

FIG. 2 shows, as an example, the case where the lower end surface 42*a* of the leeward-side second sub heat exchanger 42 is located between the air passage wall 2*w* and the second main heat exchanger 30, but the lower end surface 42*a* is only required to be located above the air passage wall 2*w*. FIG. 6 is a cross-sectional view showing a modification of the indoor unit for an air-conditioning apparatus according to Embodiment 1 of the present invention, and FIG. 7 is a schematic diagram showing a lower end surface of a second sub heat exchanger in FIG. 6. As shown in FIGS. 6 and 7, the leeward-side second sub heat exchanger 42 is disposed and has the lower end surface 42*a* located above the air passage wall 2*w* and on a vertical line of the air passage wall 2*w*. In such a case as well, dew water from the leeward-side second sub heat exchanger 42 can be prevented from entering the air passage.

Embodiment 2

Figure 8:
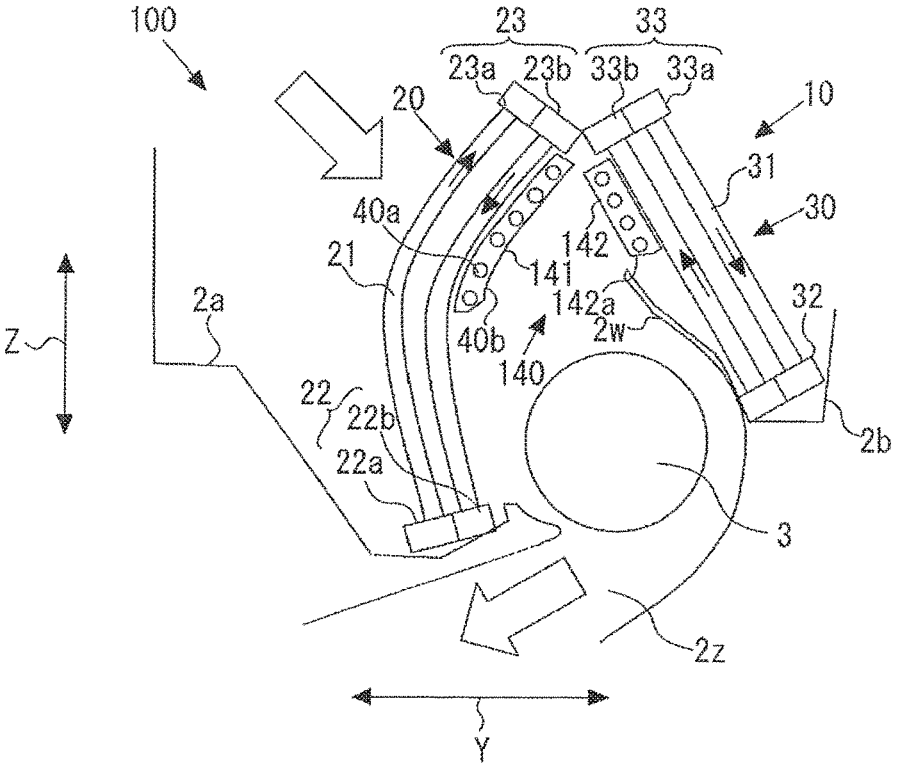
FIG. 8 is a cross-sectional view showing an indoor unit for an air-conditioning apparatus according to Embodiment 2 of the present invention.

FIG. 8 is a cross-sectional view showing an indoor unit for an air-conditioning apparatus according to Embodiment 2 of the present invention. An indoor unit 100 for an air-conditioning apparatus is described with reference to FIG. 8. In the indoor unit 100 for an air-conditioning apparatus in FIG. 8, portions having the same configuration as in the indoor unit 1 for an air-conditioning apparatus in FIG. 2 are designated by the same reference signs, and the description of the portions is omitted. The indoor unit 100 for an air-conditioning apparatus in FIG. 8 is different from the indoor unit for an air-conditioning apparatus in FIG. 2 in that a lower end surface of a sub heat exchanger unit 140 has a cut.

Figure 9:
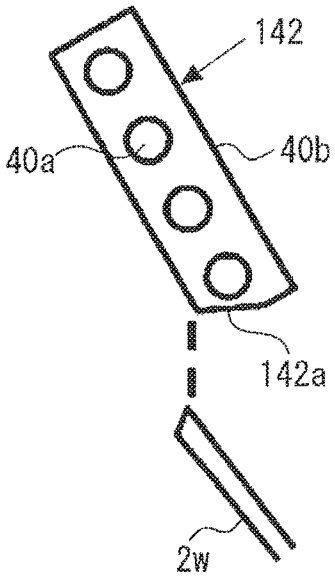
FIG. 9 is a schematic diagram showing a lower end surface of a second sub heat exchanger in FIG. 7.

FIG. 9 is a schematic diagram showing a lower end surface of a second sub heat exchanger in FIG. 7. As shown in FIGS. 8 and 9, a cut is formed, for example, along the horizontal direction (the arrow Y direction) on a lower end surface 142*a* of a second sub heat exchanger 142 of the sub heat exchanger unit 140. The shape of the cut is not limited to the above shape, and is only required to be a cut obtained by cutting a corner so that the cut extends in the horizontal direction. In addition, a cut is formed similarly on a lower end surface at the first sub heat exchanger 141. A cut may be formed only at the second sub heat exchanger 142. In the first sub heat exchanger 141 and the second sub heat exchanger 142, dew water flowing down from upper portions of the first sub heat exchanger 141 and the second sub heat exchanger 142 is guided in a direction away from the air-sending fan 3 by the cut of the lower end surface 142*a*.

According to Embodiment 2, as the cut is formed on the lower end surface 142*a*, dew water dropping from the sub heat exchanger unit 140 can be assuredly prevented from entering the air passage.

Embodiment 3

Figure 10:
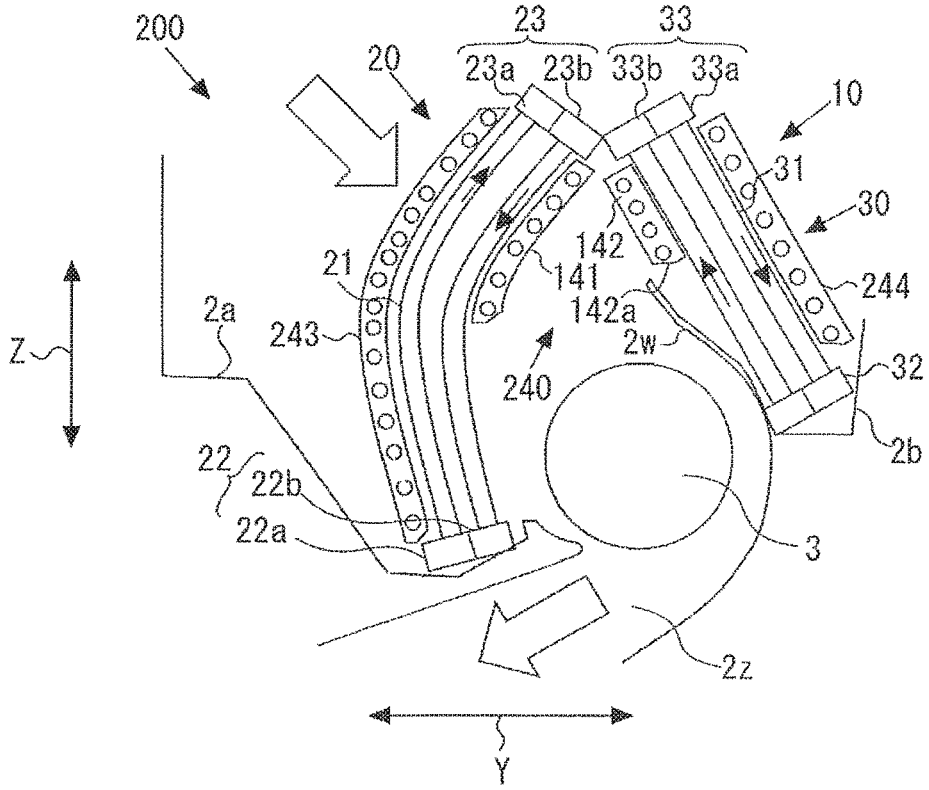
FIG. 10 is a cross-sectional view showing an indoor unit for an air-conditioning apparatus according to Embodiment 3 of the present invention.

FIG. 10 is a cross-sectional view showing an indoor unit for an air-conditioning apparatus according to Embodiment 3 of the present invention. An indoor unit 200 for an air-conditioning apparatus is described with reference to FIG. 10. In the indoor unit 200 for an air-conditioning apparatus in FIG. 10, portions having the same configuration as in the indoor unit 100 for an air-conditioning apparatus in FIG. 8 are designated by the same reference signs, and the description of the portions is omitted. The indoor unit 200 for an air-conditioning apparatus in FIG. 10 is different from the indoor unit 100 for an air-conditioning apparatus in FIG. 8 in that a sub heat exchanger unit 240 includes a windward-side first sub heat exchanger 243 and a windward-side second sub heat exchanger 244.

The windward-side first sub heat exchanger 243 in FIG. 10 is disposed at the windward side of the first main heat exchanger 20, and the windward-side second sub heat exchanger 244 is disposed at the windward side of the first main heat exchanger 20. The windward-side first sub heat exchanger 243 and the windward-side second sub heat exchanger 244 have, for example, the same configurations as those of the leeward-side first sub heat exchanger 41 and the leeward-side second sub heat exchanger 42, respectively. In addition, the windward-side first sub heat exchanger 243 and the windward-side second sub heat exchanger 244 are provided to cover the front surfaces of the first main heat exchanger 20 and the second main heat exchanger 30, respectively.

In particular, the total number of refrigerant pipe branches in the leeward-side first sub heat exchanger 41 and the leeward-side second sub heat exchanger 42 is equal to or larger than the total number of refrigerant pipe branches in the windward-side first sub heat exchanger 243 and the windward-side second sub heat exchanger 244. Thus, the flow rate of the refrigerant in the windward-side first sub heat exchanger 243 and the windward-side second sub heat exchanger 244 can be reduced to reduce refrigerant pressure loss.

Figure 11:
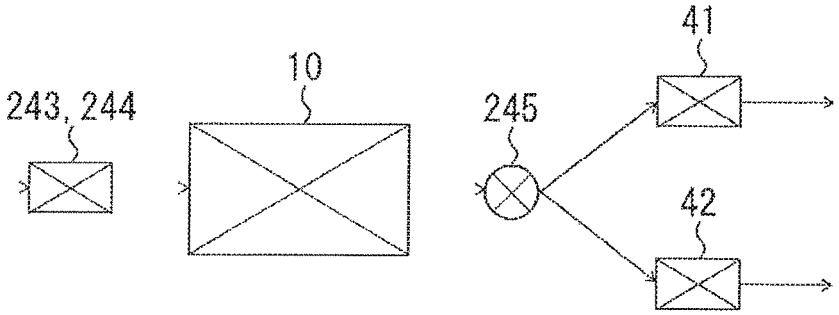
FIG. 11 is a schematic diagram showing an example of flow of refrigerant during cooling operation of the indoor unit for an air-conditioning apparatus in FIG. 10.

FIG. 11 is a schematic diagram showing an example of a refrigerant passage during cooling operation in the indoor unit for an air-conditioning apparatus in FIG. 10. As shown in FIG. 11, during cooling operation, after the refrigerant flows from the outdoor unit into the windward-side first sub heat exchanger 243 and the windward-side second sub heat exchanger 244, the refrigerant flows into the main heat exchanger unit 10. The refrigerant having exchanged heat at the main heat exchanger unit 10 is throttled at a reheat valve (expansion device) 245, and then flows into the leeward-side first sub heat exchanger 41 and the leeward-side second sub heat exchanger 42. Subsequently, the refrigerant having exchanged heat at the leeward-side first sub heat exchanger 41 and the leeward-side second sub heat exchanger 42 flows out to the outdoor unit.

During heating operation, the refrigerant flows from the outdoor unit into the leeward-side first sub heat exchanger 41 and the leeward-side second sub heat exchanger 42, passes through the reheat valve (expansion device) 245, and then flows into the main heat exchanger unit 10. Then, the refrigerant having exchanged heat at the main heat exchanger unit 10 flows into the windward-side first sub heat exchanger 243 and the windward-side second sub heat exchanger 244, and then flows out to the outdoor unit.

According to Embodiment 3, a state is obtained in which a subcooling portion is provided by the windward-side first sub heat exchanger 243 and the windward-side second sub heat exchanger 244. Thus, the heat exchanger performance of the main heat exchanger unit 10 can be improved. That is, the refrigerant flowing from the outdoor unit into the windward-side first sub heat exchanger 243 and the windward-side second sub heat exchanger 244 during cooling operation is, for example, in a liquid phase state having a quality (dryness) of 0 to 0.2, and the quality increases as the refrigerant flows through the main heat exchanger unit 10 at the downstream side, the leeward-side first sub heat exchanger 41, and the leeward-side second sub heat exchanger 42. Meanwhile, during heating operation, the refrigerant flowing in from the outdoor unit is, for example, in a gas phase state having a quality of 1, and the quality decreases as the refrigerant flows through the main heat exchanger unit 10 at the downstream side, the leeward-side first sub heat exchanger 41, and the leeward-side second sub heat exchanger 42.

Figure 12:
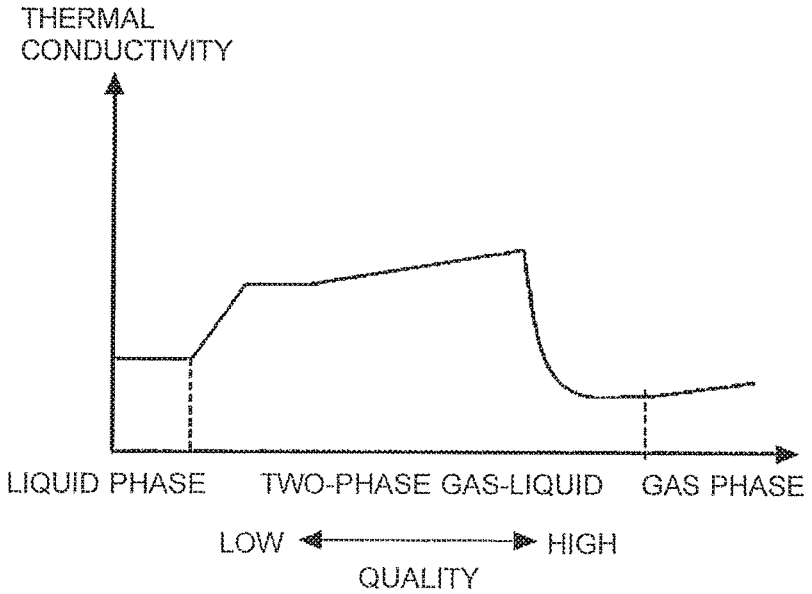
FIG. 12 is a graph showing a relationship between a thermal conductivity and a state of refrigerant in a general heat exchanger.

FIG. 12 is a graph showing a relationship between a thermal conductivity and a state of refrigerant in a general heat exchanger. FIG. 12 indicates that the thermal conductivity in the heat exchanger is high when the refrigerant is in a two-phase gas-liquid state. Thus, by providing the subcooling portion by the windward-side first sub heat exchanger 243 and the windward-side second sub heat exchanger 244, the refrigerant in a two-phase gas-liquid state can be caused to flow through the main heat exchanger unit 10 during cooling operation to increase the thermal conductivity, thereby improving the heat exchanger performance of the main heat exchanger unit 10. During heating operation as well, the refrigerant in a two-phase gas-liquid state can be caused to flow through the main heat exchanger unit 10 by the leeward-side first sub heat exchanger 41 and the leeward-side second sub heat exchanger 42, to increase the thermal conductivity.

Embodiment 4

Figure 13:
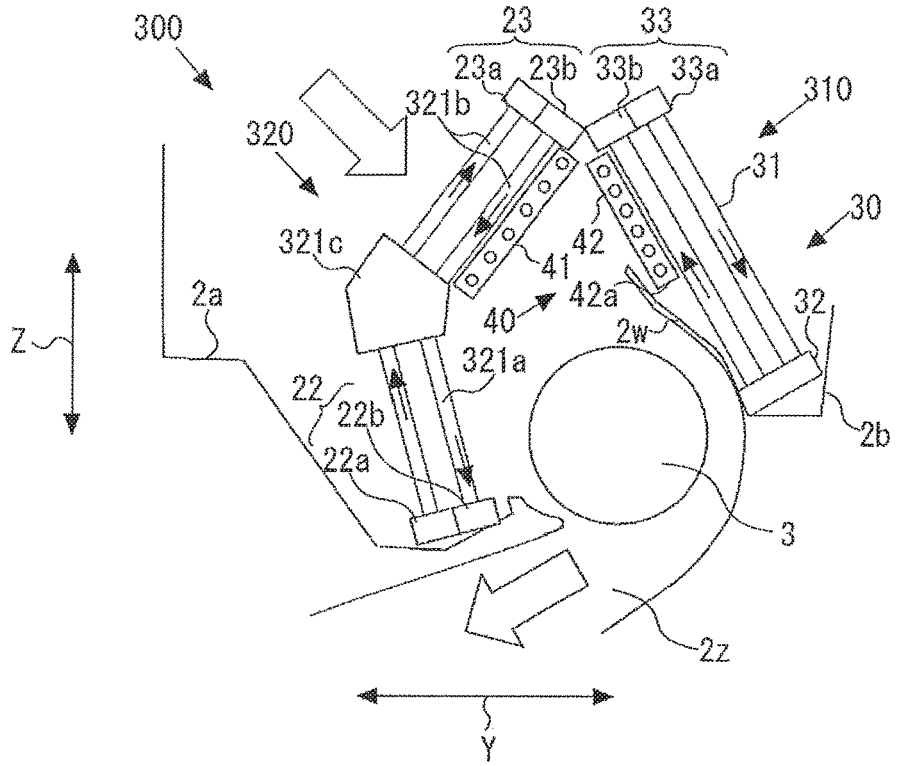
FIG. 13 is a cross-sectional view showing an indoor unit for an air-conditioning apparatus according to Embodiment 4 of the present invention.

FIG. 13 is a cross-sectional view showing an indoor unit for an air-conditioning apparatus according to Embodiment 4 of the present invention. An indoor unit 300 for an air-conditioning apparatus is described with reference to FIG. 13. In the indoor unit 300 for an air-conditioning apparatus in FIG. 13, portions having the same configuration as in the indoor unit 100 for an air-conditioning apparatus in FIG. 8 are designated by the same reference signs, and the description of the portions is omitted. The indoor unit 300 for an air-conditioning apparatus in FIG. 6 is different from the indoor unit 100 for an air-conditioning apparatus in FIG. 8 in the configuration of a first main heat exchanger 320.

The first main heat exchanger 320 in FIG. 13 includes, in addition to the first lower header 22 and the first upper header 23, lower heat-transfer pipes 321*a* connected to the first lower header 22, upper heat-transfer pipes 321*b* connected to the first upper header 23, and an intermediate header 321*c* connecting the upper ends of the lower heat-transfer pipes 321*a* to the lower ends of the upper heat-transfer pipes 321*b*. The lower heat-transfer pipes 321*a* and the upper heat-transfer pipes 321*b* are each formed in a linear shape, and are connected to each other at the intermediate header 321*c* to bend. In the intermediate header 321*c*, among the lower heat-transfer pipes 321*a* and the upper heat-transfer pipes 321*b*, the lower heat-transfer pipe 321*a* and the upper heat-transfer pipe 321*b* at the side of the front case 2*b*, and the lower heat-transfer pipe 321*a* and the upper heat-transfer pipe 321*b* at the side of the back case 2*a* are partitioned off to form different refrigerant passages that are the same as the refrigerant passages in FIG. 2 described above.

According to Embodiment 4, as the lower heat-transfer pipes 321*a* and the upper heat-transfer pipes 321*b* each formed in a linear shape are included and are connected to each other at the intermediate header 321*c* to bend, the mount area of the first main heat exchanger 320 can be increased to improve air-conditioning performance, similarly as in the case of a curved surface shape as in Embodiment 1. In addition, as a return header is provided to the second main heat exchanger 30 also in Embodiment 4, the air-conditioning performance can be improved.

Figure 14:
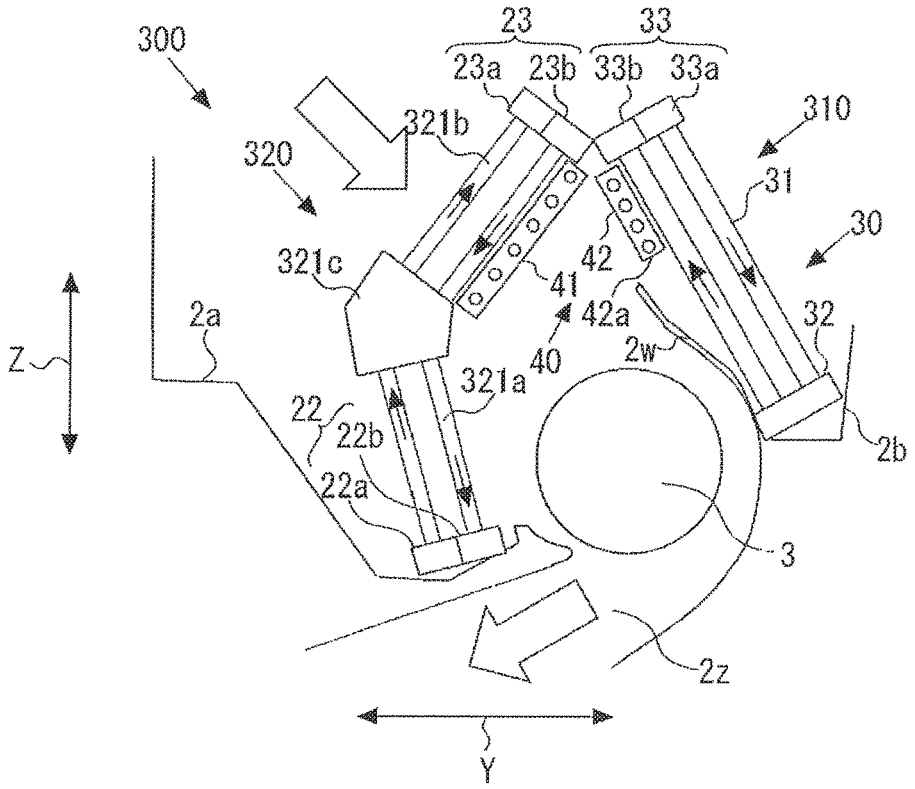
FIG. 14 is a cross-sectional view showing a modification of the indoor unit for an air-conditioning apparatus according to Embodiment 4 of the present invention.

Even in the case of the main heat exchanger unit 310 in FIG. 13, the above-described sub heat exchanger units having various configurations are applicable. Specifically, FIG. 14 is a cross-sectional view showing a modification of the indoor unit for an air-conditioning apparatus according to Embodiment 4 of the present invention. As shown in FIG. 14, the leeward-side second sub heat exchanger 42 may be disposed and may have the lower end surface 42*a* located above the air passage wall 2*w* and on a vertical line of the air passage wall 2*w*.

Figure 15:
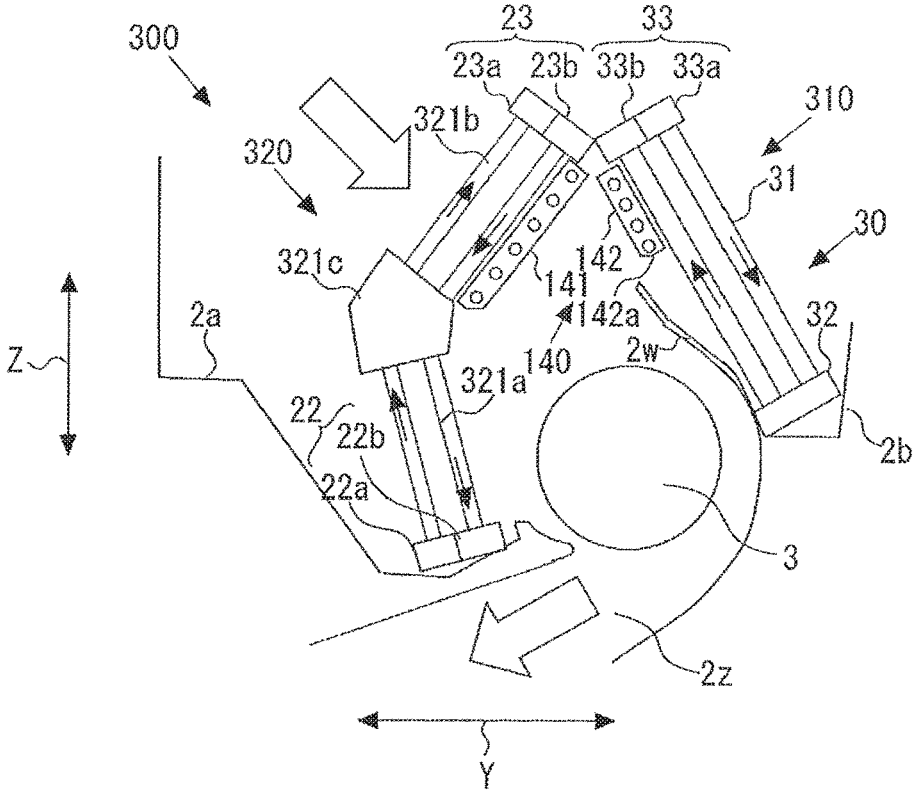
FIG. 15 is a cross-sectional view showing a state where a sub heat exchanger unit of Embodiment 2 is applied to the indoor unit for an air-conditioning apparatus according to Embodiment 4 of the present invention.

FIG. 15 is a cross-sectional view showing a state where the sub heat exchanger unit of Embodiment 2 is applied to the indoor unit for an air-conditioning apparatus according to Embodiment 4 of the present invention. As shown in FIG. 15, the lower end surfaces of the sub heat exchanger unit 140 have cuts to assuredly prevent dew water from entering the air passage.

Figure 16:
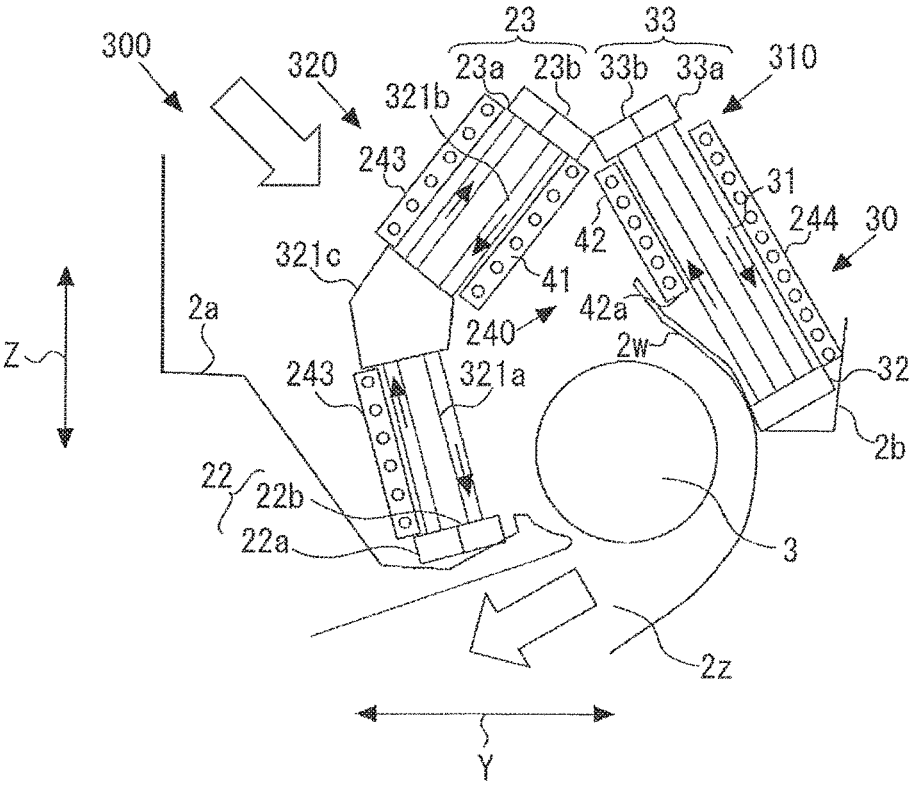
FIG. 16 is a cross-sectional view showing a state where a sub heat exchanger unit of Embodiment 3 is applied to the indoor unit for an air-conditioning apparatus according to Embodiment 4 of the present invention.

FIG. 16 is a cross-sectional view showing a state where the sub heat exchanger unit of Embodiment 3 is applied to the indoor unit for an air-conditioning apparatus according to Embodiment 4 of the present invention. As shown in FIG. 16, a subcooling portion is provided by the windward-side first sub heat exchangers 243 and the windward-side second sub heat exchanger 244 to cause the refrigerant in a two-phase gas-liquid state to flow through the main heat exchanger unit 10 to increase the thermal conductivity, thereby improving the heat exchanger performance of the main heat exchanger unit 10.

Embodiment 5

Figure 17:
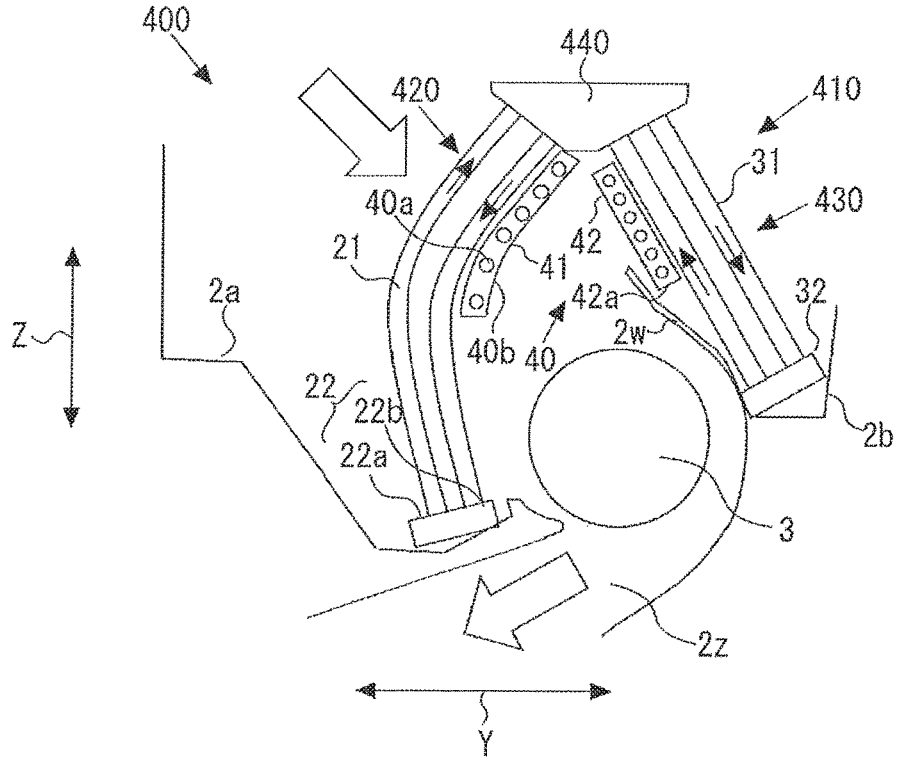
FIG. 17 is a cross-sectional view showing an indoor unit for an air-conditioning apparatus according to Embodiment 5 of the present invention.

FIG. 17 is a cross-sectional view of an indoor unit for an air-conditioning apparatus according to Embodiment 5 of the present invention. An indoor unit 400 for an air-conditioning apparatus is described with reference to FIG. 17. In the indoor unit 400 for an air-conditioning apparatus in FIG. 17, portions having the same configuration as in the indoor unit 100 for an air-conditioning apparatus in FIG. 8 are designated by the same reference signs, and the description of the portions is omitted. The indoor unit 200 for an air-conditioning apparatus in FIG. 17 is different from the indoor unit 100 for an air-conditioning apparatus in FIG. 2 in that a first upper header of a first main heat exchanger 420 and a second upper header of a second main heat exchanger 430 are integrally formed as a connection header 440.

The connection header 440 has, for example, a substantially triangular cross-sectional shape, and in the connection header 440, for example, a first heat-transfer pipe 21 at the front side of the first main heat exchanger 420 and a second heat-transfer pipe 31 at the back side of the second main heat exchanger 430 are connected to each other to form a refrigerant passage that is the same as in FIG. 2. In particular, cutout portions 240*a* for reducing air resistance are formed at corners of the connection header 440.

According to Embodiment 5, as the first upper header of the first main heat exchanger 420 and the second upper header of the second main heat exchanger 430 are integrally formed, the number of components can be reduced to simplify the structure of a main heat exchanger unit 210. In addition, also in Embodiment 4, a return header is provided to the second main heat exchanger 30, and thus the air-conditioning performance can be improved. Even in the case as in Embodiment 5, a refrigerant passage may be formed as shown in FIG. 5 so that the refrigerant flows in through the connection header 440.

Figure 18:
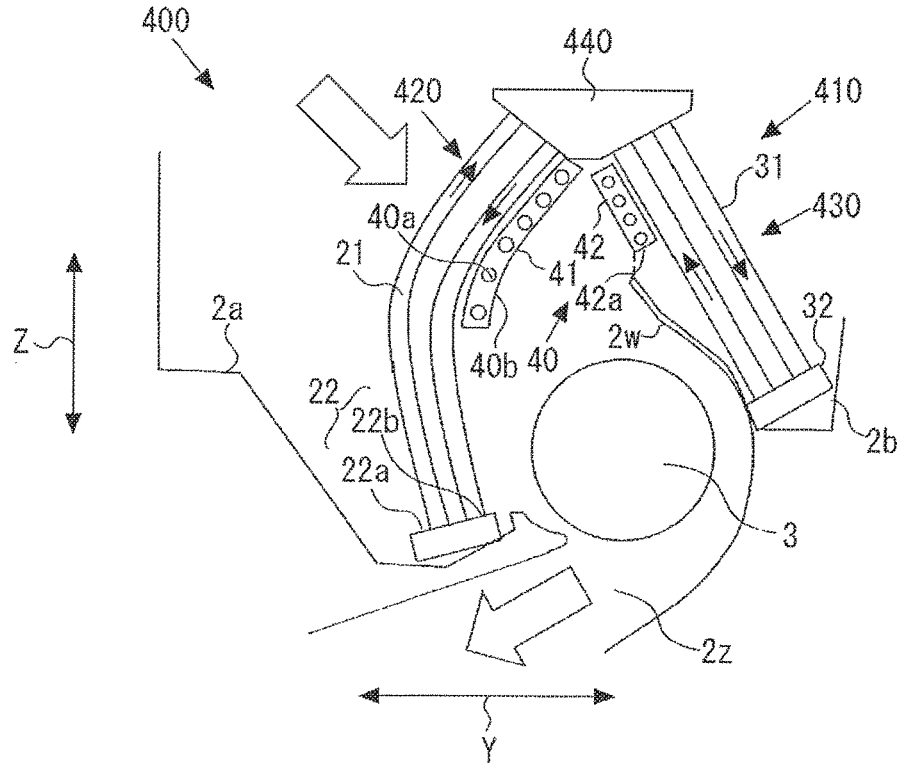
FIG. 18 is a cross-sectional view showing a modification of the indoor unit for an air-conditioning apparatus according to Embodiment 5 of the present invention.

Even in the case of a main heat exchanger unit 410 as shown in FIG. 17, the above-described sub heat exchanger units having various configurations are applicable. Specifically, FIG. 18 is a cross-sectional view showing a modification of the indoor unit for an air-conditioning apparatus according to Embodiment 5 of the present invention. As shown in FIG. 18, the leeward-side second sub heat exchanger 42 may have a lower end surface 42*a* that is located above the air passage wall 2*w* and on a vertical line of the air passage wall 2*w*.

Figure 19:
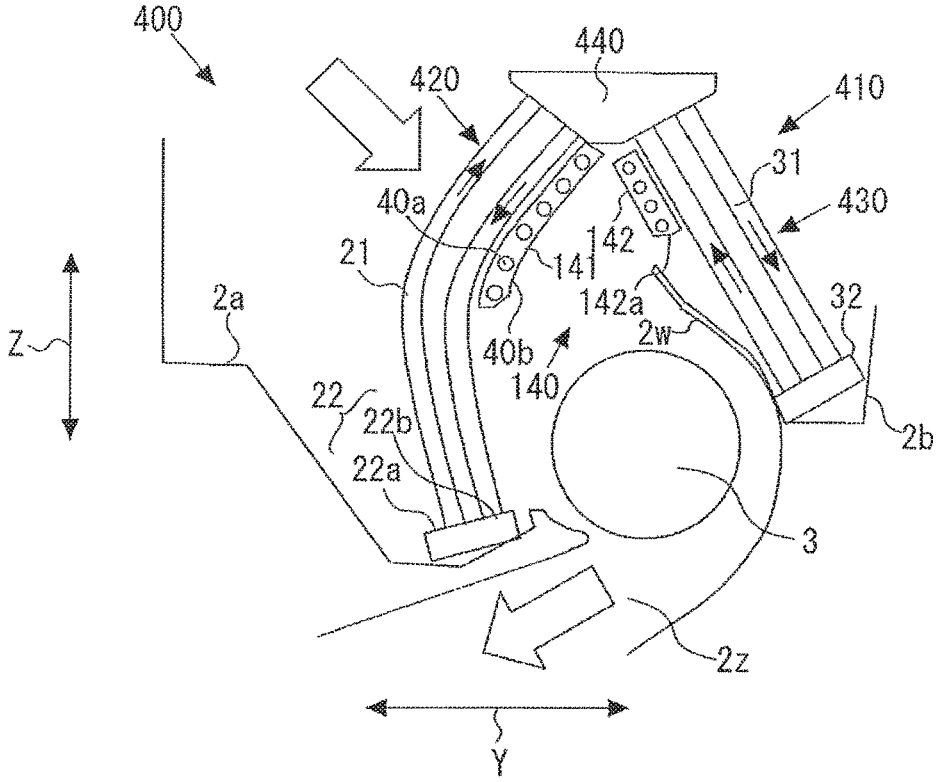
FIG. 19 is a cross-sectional view showing a state where the sub heat exchanger unit of Embodiment 2 is applied to the indoor unit for an air-conditioning apparatus according to Embodiment 5 of the present invention.

FIG. 19 is a cross-sectional view showing a state where the sub heat exchanger unit of Embodiment 2 is applied to the indoor unit for an air-conditioning apparatus according to Embodiment 5 of the present invention. As shown in FIG. 19, the lower end surfaces of the sub heat exchanger unit 140 have cuts to assuredly prevent dew water from entering the air passage.

Figure 20:
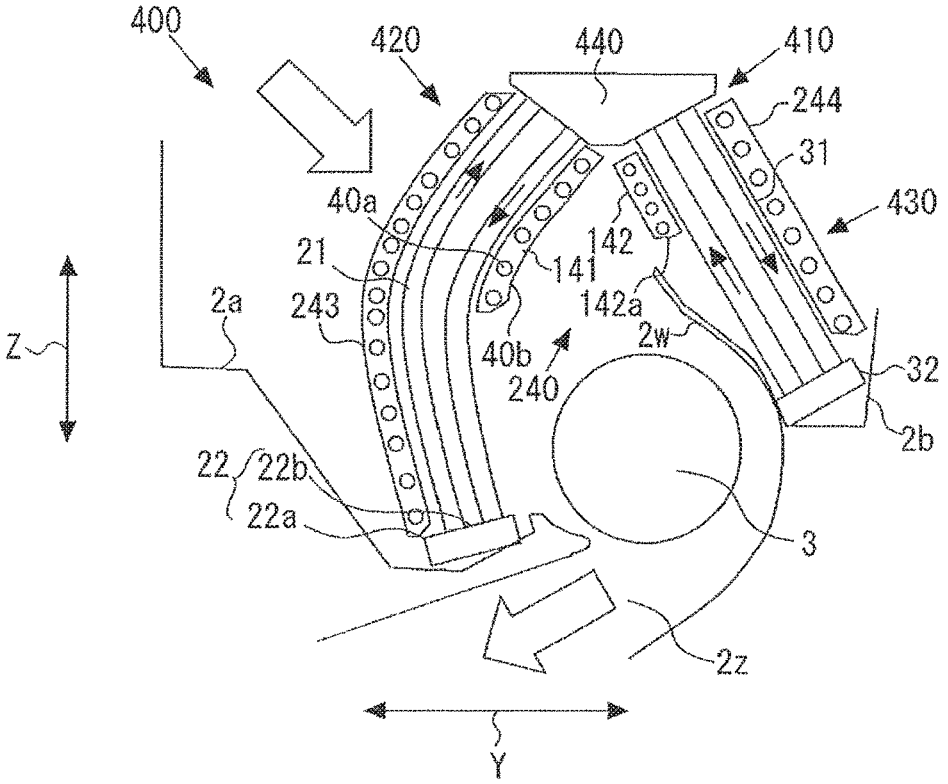
FIG. 20 is a cross-sectional view showing a state where the sub heat exchanger unit of Embodiment 3 is applied to the indoor unit for an air-conditioning apparatus according to Embodiment 5 of the present invention.

FIG. 20 is a cross-sectional view showing a state where the sub heat exchanger unit of Embodiment 3 is applied to the indoor unit for an air-conditioning apparatus according to Embodiment 5 of the present invention. As shown in FIG. 20, a subcooling portion is provided by the windward-side first sub heat exchanger 243 and the windward-side second sub heat exchanger 244 to cause the refrigerant in a two-phase gas-liquid state to flow through the main heat exchanger unit 10 to increase the thermal conductivity, thereby improving the heat exchanger performance of the main heat exchanger unit 10.

Embodiments of the present invention are not limited to the embodiments described above. For example, the case is shown where the main heat exchanger unit 10, 110, or 210 includes two heat exchangers, that is, the first main heat exchanger 20, 120, or 220 and the second main heat exchanger 30 or 230 in each of Embodiments 1 to 5 described above. However, the main heat exchanger unit 10, 110, or 210 may include three or more heat exchangers. In this case as well, refrigerant distributing characteristics can be improved by disposing heat-transfer pipes to extend in the vertical direction and by disposing a distributing header to extend in the horizontal direction.

The case is shown where two refrigerant passages are formed in the air flow direction in each of the first main heat exchanger 20, 120, or 220 and the second main heat exchanger 30 or 230 in each of Embodiments 1 to 5 described above; however, three or more refrigerant passages may be formed. Furthermore, the case is shown where the refrigerant flows in the first main heat exchanger 20, 120, or 220 and the second main heat exchanger 30 or 230 in the same direction in the width direction (arrow X direction); however, the header may be divided so that the refrigerant flows in different directions at the upper and lower sides also in the width direction (arrow Y direction). In addition, the wall-mounted type indoor unit is shown in each of Embodiments 1 to 3 described above; however, the present invention can also apply to a ceiling-embedded type indoor unit.

Figure 21:
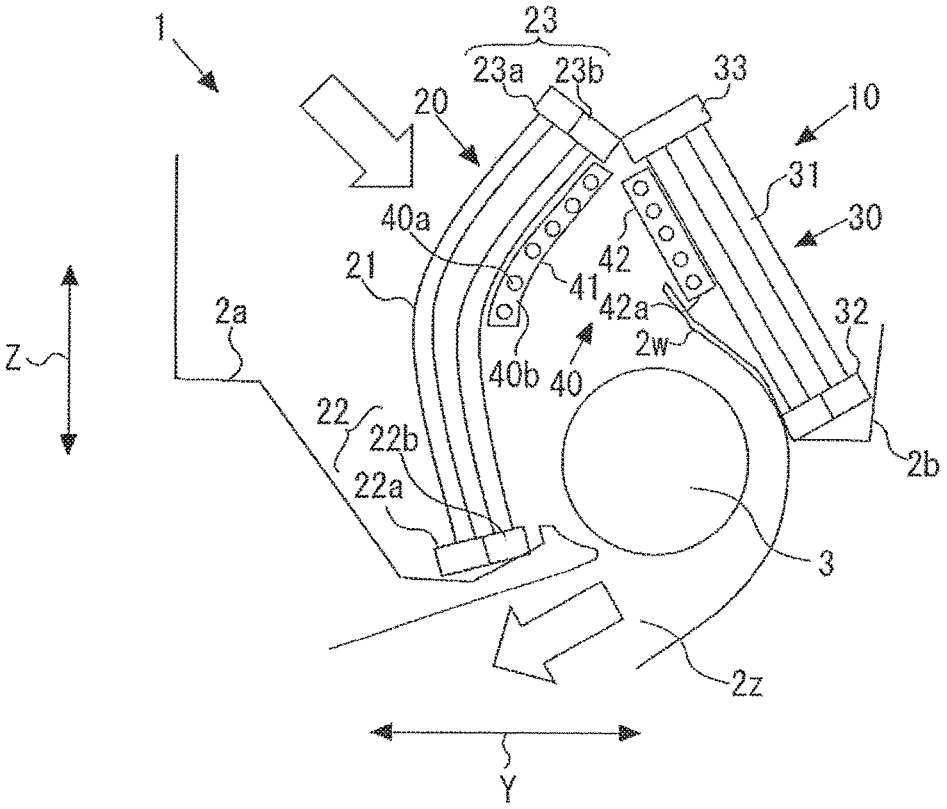
FIG. 21 is a cross-sectional view showing a modification of the indoor unit for an air-conditioning apparatus of the present invention.

Furthermore, the case is shown where the second lower header 32 is a return header and the second upper header 33 is composed of division headers in the second main heat exchanger 30 of each of Embodiments 1 to 5 described above; however, the second upper header 33 may be a return header, and the second lower header 32 may be composed of division headers. FIG. 21 is a cross-sectional view showing a modification of the indoor unit for an air-conditioning apparatus of the present invention. Portions having the same configuration as in the indoor unit for an air-conditioning apparatus in FIG. 1 are designated by the same reference signs, and the description of the portions is omitted. Even in this case, the first main heat exchanger 20 and the second main heat exchanger 30 are connected so that the second lower header 32 is connected to the first upper header 23 or the first lower header 22 to form a continuous refrigerant passage. In addition, the intermediate header 321*c* shown in Embodiment 4 may be used in the first main heat exchanger 20. Moreover, as shown in Embodiment 2, the cut may be formed on the lower end surface 142*a* of the second sub heat exchanger 142, or as in Embodiment 3, the sub heat exchanger unit 240 may include the windward-side first sub heat exchanger 243 and the windward-side second sub heat exchanger 244.

During cooling operation of the indoor unit 1 shown in FIG. 21, the quality approaches 1 (gas phase) as the refrigerant exchanges heat in the second main heat exchanger 30. Then, when the refrigerant is dried in the middle of the second main heat exchanger 30, dew water may occur. At this time, in the case where the second upper header 33 is a return header as described above, the location where the refrigerant is dried is inside the air passage wall 2*w*. Thus, dew water can be prevented from occurring from the second main heat exchanger 30 into the air passage.

REFERENCE SIGNS LIST

1, 100, 200, 300, 400 indoor unit for an air-conditioning apparatus 2 case 2*a* back case 2*b* front case 2*w* air passage wall 2*x* air inlet 2*z* air outlet air-sending fan 10, 210, 310, 410 main heat exchanger unit 20, 320, 420 first main heat exchanger 21 first heat-transfer pipe 22 first lower header 22*a*, 22*b* first lower division header 23 first upper header 23*a*, 23*b* first upper division header 24 first heat transfer fin 30, 430 second main heat exchanger second heat-transfer pipe 31*a*, 31*b* refrigerant passage 32 second lower header 33 second upper header 33*a*, 33*b* second upper division header 34 second heat transfer fin 40, 140, 240 sub heat exchanger unit 40*a* heat-transfer pipe 40*b* heat transfer fin 41, 141 leeward-side first sub heat exchanger 42, 142 leeward-side second sub heat exchanger 42*a*, 142*a* lower end surface 240*a* cutout portion 243 windward-side first sub heat exchanger 244 windward-side second sub heat exchanger 245 reheat valve (expansion device) 321*a* lower heat-transfer pipe 321*b* upper heat-transfer pipe 321*c* intermediate header 440 connection header

The invention claimed is:

1. An indoor unit for an air-conditioning apparatus comprising a case, an air-sending fan accommodated in the case, a main heat exchanger unit provided to cover the air-sending fan and configured to exchange heat between refrigerant and air, and a sub heat exchanger unit provided to a leeward side of the main heat exchanger unit, the main heat exchanger unit including a first main heat exchanger disposed at a front side of the case and including a first heat-transfer pipe extending in a vertical direction, and a second main heat exchanger disposed at a back side of the case and including a second heat-transfer pipe extending in the vertical direction, the case including an air passage wall arranged between the air-sending fan and the second main heat exchanger and forming an air passage through which air sent from the air-sending fan flows, the sub heat exchanger unit including a leeward-side first sub heat exchanger disposed at a leeward side of the first main heat exchanger and including a heat-transfer pipe extending in a width direction of the case, and a leeward-side second sub heat exchanger including a heat-transfer pipe extending in the width direction of the case, the leeward-side second sub heat exchanger having a lower end surface located above the air passage wall, the leeward-side second sub heat exchanger being disposed at a leeward side of the second main heat exchanger and at a side of an upper portion of the second main heat exchanger.

2. The indoor unit for an air-conditioning apparatus of claim 1, wherein the leeward-side second sub heat exchanger is disposed so that the lower end surface of the leeward-side second sub heat exchanger is located inward of an end of the air passage wall.

3. The indoor unit for an air-conditioning apparatus of claim 1, wherein the leeward-side second sub heat exchanger is disposed so that the lower end surface of the leeward-side second sub heat exchanger and an end of the air passage wall are present on a vertical line.

4. The indoor unit for an air-conditioning apparatus of claim 1, wherein the sub heat exchanger unit is configured to cover 80% or less of a total area of the main heat exchanger unit.

5. The indoor unit for an air-conditioning apparatus of claim 1, wherein a cut is formed on the lower end surface of the leeward-side second sub heat exchanger.

6. The indoor unit for an air-conditioning apparatus of claim 1, wherein the sub heat exchanger unit further includes a windward-side first sub heat exchanger disposed at a windward side of the first main heat exchanger, and a windward-side second sub heat exchanger disposed at a windward side of the second main heat exchanger and including a heat-transfer pipe extending in the width direction of the case.

7. The indoor unit for an air-conditioning apparatus of claim 6, wherein a total number of refrigerant pipe branches in the leeward-side first sub heat exchanger and the leeward-side second sub heat exchanger is equal to or larger than a total number of refrigerant pipe branches in the windward-side first sub heat exchanger and the windward-side second sub heat exchanger.

8. The indoor unit for an air-conditioning apparatus of claim 1, wherein each of the leeward-side first sub heat exchanger and the leeward-side second sub heat exchanger includes heat transfer fins having a fin pitch of 1.0 to 1.5 mm between the heat-transfer pipes.

9. The indoor unit for an air-conditioning apparatus of claim 1, wherein a plurality of the first heat-transfer pipes are each formed in a curved shape projecting toward the front side of the case.

10. The indoor unit for an air-conditioning apparatus of claim 1, wherein a plurality of the first heat-transfer pipes and a plurality of the second heat-transfer pipes form a plurality of refrigerant passages arranged in the width direction of the case and an air flow direction, and the main heat exchanger unit includes a plurality of division headers each dividing and connecting the plurality of refrigerant passages arranged in the air flow direction and connecting in parallel the plurality of refrigerant passages arranged in the width direction of the case, and a return header connecting and turning back the plurality of refrigerant passages arranged in the air flow direction divided in the plurality of division headers and connecting in parallel a plurality of the heat-transfer pipes in the width direction of the case.

11. The indoor unit for an air-conditioning apparatus of claim 10, wherein the first main heat exchanger includes a first lower header constituted of the plurality of division headers connected to lower ends of the plurality of the first heat-transfer pipes, and a first upper header constituted of the plurality of division headers connected to upper ends of the plurality of the first heat-transfer pipes, the second main heat exchanger includes a second lower header constituted of the return header connected to lower ends of the plurality of the second heat-transfer pipes, and a second upper header constituted of the plurality of division headers connected to upper ends of the plurality of the second heat-transfer pipes, and the first main heat exchanger and the second main heat exchanger are connected to form a continuous refrigerant passage.

12. The indoor unit for an air-conditioning apparatus of claim 11, wherein the first upper header of the first main heat exchanger and the second upper header of the second main heat exchanger are integrally formed as a connection header.

13. The indoor unit for an air-conditioning apparatus of claim 10, wherein the first main heat exchanger includes a first lower header constituted of the plurality of division headers connected to lower ends of the plurality of the first heat-transfer pipes, and a first upper header constituted of the plurality of division headers connected to upper ends of the plurality of the first heat-transfer pipes, the second main heat exchanger includes a second lower header constituted of the plurality of division headers connected to lower ends of the plurality of the second heat-transfer pipes, and a second upper header constituted of the return header connected to upper ends of the plurality of the second heat-transfer pipes, and the first main heat exchanger and the second main heat exchanger are connected to form a continuous refrigerant passage.

14. The indoor unit for an air-conditioning apparatus of claim 11, wherein the first heat-transfer pipe includes a lower heat-transfer pipe connected to the first lower header and formed in a linear shape, and an upper heat-transfer pipe connected to the first upper header and formed in a linear shape, the first main heat exchanger includes an intermediate header connecting the lower heat-transfer pipe and the upper heat-transfer pipe, and the lower heat-transfer pipe and the upper heat-transfer pipe are connected to each other at the intermediate header to bend in a shape projecting toward the front side of the case.

* * * * *